US007806506B2

(12) United States Patent
Umeda

(10) Patent No.: US 7,806,506 B2
(45) Date of Patent: Oct. 5, 2010

(54) DROPLET EJECTING DEVICE HAVING CAP THAT SEALS NOZZLES

(75) Inventor: Takaichiro Umeda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 145 days.

(21) Appl. No.: 12/275,042

(22) Filed: Nov. 20, 2008

(65) Prior Publication Data

US 2009/0141073 A1 Jun. 4, 2009

(30) Foreign Application Priority Data

Nov. 30, 2007 (JP) ..... 2007-310592

(51) Int. Cl.
*B41J 2/165* (2006.01)

(52) U.S. Cl. ..... 347/29

(58) Field of Classification Search ..... 347/29
See application file for complete search history.

(56) References Cited

U.S. PATENT DOCUMENTS 6,286,930 B1 * 9/2001 Kobayashi et al. ..... 347/29

FOREIGN PATENT DOCUMENTS

JP 2002-127435 A 5/2002
JP 2005-262821 A 9/2005

* cited by examiner

*Primary Examiner*—Matthew Luu
*Assistant Examiner*—Alejandro Valencia
(74) *Attorney, Agent, or Firm*—Baker Botts L.L.P.

(57) ABSTRACT

Each of first and second caps includes a concave section and a lip section configured to be in contact with a nozzle surface of a droplet ejecting head, so as to seal nozzles when a moving section moves a base toward the droplet ejecting head. The first and second caps are arranged in a second direction intersecting a nozzle alignment direction, the first cap being closer to a pivot section of a cap supporting plate than the second cap is. The concave sections of the first and second caps face different directions from each other. In a state where the second cap seals the nozzles in a part of a plurality of nozzle arrays, the first cap is spaced away from the droplet ejecting head in such a manner that the lip section of the first cap is gradually away from the nozzle surface toward a pivot section side.

10 Claims, 13 Drawing Sheets

DROPLET EJECTING DEVICE HAVING CAP THAT SEALS NOZZLES

CROSS REFERENCE TO RELATED APPLICATIONS

This application claims priority from Japanese Patent Application No. 2007-310592 filed Nov. 30, 2007. The entire content of the priority application is incorporated herein by reference.

TECHNICAL FIELD

The invention relates to a droplet ejecting device that ejects liquid droplets.

BACKGROUND

Conventionally, an inkjet printer serving as a droplet ejecting device is provided with an inkjet head having nozzles for each of colors in black, cyan, magenta, and yellow, and the nozzles eject ink droplets in each color toward printing paper for printing an image and the like onto the printing paper.

In such an inkjet printer, there has been a problem that ink cannot be ejected from the nozzles due to the causes of an increase in viscosity of ink within an ink channel of the inkjet head, entering of an air bubble into the ink channel.

Hence, a common inkjet printer is configured to perform a purge operation of forcibly discharging ink within the ink channel, thereby discharging ink with increased viscosity and an air bubble within the ink channel, so that ink droplets can be ejected normally through the nozzles.

There are several methods of sucking ink with an inkjet printer that performs such a purge operation. One of the methods is to discharge ink through all the nozzles simultaneously in order to shorten the time of the purge operation.

However, in this purge operation, ink is also discharged through normal nozzles, which increases the amount of ink discharged wastefully.

Accordingly, one proposed printer is configured in such a manner that ink is discharged only through the nozzles that require a purge operation, in order to reduce the consumption of wasted ink during the purge operation.

Japanese Patent Application Publication No. 2005-262821 (see FIG. 7) disclose an inkjet printer including a print head, a cap member, and a carriage. The print head is provided with nozzle arrays capable of ejecting ink in four colors, one nozzle array being provided for each of the four colors. The cap member includes a first cap section capable of sealing the nozzle arrays for three colors and a second cap section capable of sealing the nozzle array for one color. Each of the first cap section and the second cap section has a predetermined open surface. The carriage moves the print head relative to the cap member. The carriage is provided with an optical sensor that is capable of detecting a dot pattern of a recording medium.

Here, when executing a missing-dot check for detecting whether ink droplets are normally ejected through the nozzles, after printing a dot pattern for the missing-dot check on a recording medium, a control unit of the inkjet printer controls the optical sensor to detect the dot pattern on the recording medium.

After the detection, if nozzles with missing dots are detected in each of the nozzle arrays for all the colors, the first cap section and the second cap section can seal the nozzle arrays for all the colors for performing a purge operation simultaneously.

In contrast, if nozzles with missing dots are detected only in the nozzle array for one color, the print head is positioned so that the second cap section is in confrontation with the above-described nozzle array, and the second cap section seals only the nozzle array including the nozzles with missing dots for performing a purge operation.

Accordingly, the inkjet printer can perform a purge operation simultaneously for all the colors, and also can perform a purge operation by selecting the nozzle array for one color. Thus, the time of the purge operation can be shortened, and the consumption amount of wasted ink can be reduced.

SUMMARY

In the inkjet printer disclosed in Japanese Patent Application Publication No. 2005-262821, force with a predetermined magnitude (hereinafter referred to as "urging force") is applied to the cap member in a direction toward the print head, in order to ensure the sealing force of the cap member.

Further, the first cap section and the second cap section are arranged in the moving direction of the print head. One of the first cap section and the second cap section is selected depending on the nozzle array to be purged, and the print head is moved so that the selected one of the first and second cap sections is in confrontation with the nozzle array to be sealed.

Especially, when the second cap section is used to purge the nozzle array for one color (see FIG. 7 of Japanese Patent Application Publication No. 2005-262821), the positional relationship between the print head and the cap member varies depending on the nozzle array to be sealed, and the contact area between the print head and the cap member also changes.

If the contact area changes in this way, the magnitude of the force acting on a unit area in the contact region (the magnitude of pressure) also changes. Hence, the force of causing the cap member to be in close contact with the print head (sealing force) changes, and there is sometimes a problem that sufficient sealing force cannot be obtained.

Accordingly, there is a method of adjusting the urging force for each of the nozzle array to be sealed, so that the same (constant) sealing force is always obtained when any of the nozzle arrays is sealed. With this method, sufficient sealing force can be obtained regardless of changes in the contact area between the cap member and the print head.

However, the urging force needs to be changed for each of the nozzle arrays, which causes the configuration to become complex.

Hence, as a method of avoiding the above-described complex configuration, it is conceivable that only the urging force required for sealing the nozzle arrays for all the colors is set in order to ensure the necessary sealing force when the contact area is maximum (i.e., when the nozzle arrays for all the colors are sealed).

In this way, when the nozzle array for one color is sealed, the sealing force is greater because the contact area is smaller, compared with the case in which the nozzle arrays for all the colors are sealed. Hence, sealing force sufficient for sealing the nozzle array can be ensured. Accordingly, because the sealing force never becomes insufficient, all of the nozzle arrays can be sealed reliably.

However, when a purge operation is performed only for a nozzle array located at one end in arrangement direction of the nozzle arrays (see FIG. 7(d) of Japanese Patent Application Publication No. 2005-262821), the urging force acts on the second cap section not only to urge the second cap section toward the sealed nozzle array, but also to rotate the cap member (in the counterclock direction in FIG. 7(d)) with the point where the corner of the print head contacts the cap member as the fulcrum.

Thus, there is a problem that the second cap section moves away from the print head, and that the nozzle array cannot be sealed reliably.

In view of the foregoing, it is an object of the invention to provide a droplet ejecting device that, when any one of a plurality of nozzle arrays is sealed, is capable of sealing the nozzle array reliably.

In order to attain the above and other objects, the invention provides a droplet ejecting device. The droplet ejecting device includes a droplet ejecting head, a first cap, a second cap, and a selecting section. The droplet ejecting head has a nozzle surface formed with a plurality of nozzle arrays. Each of the plurality of nozzle arrays includes a plurality of nozzles aligned in a first direction. The plurality of nozzle arrays is arranged in a second direction intersecting the first direction. The first cap is capable of sealing the plurality of nozzles in all of the plurality of nozzle arrays. The second cap is capable of sealing the plurality of nozzles in only a part of the plurality of nozzle arrays. The selecting section selects one of the first cap and the second cap, and selects at least one of the plurality of nozzle arrays to be sealed when the second cap is selected. The selecting section includes a base, a cap supporting member, an urging member, and a moving section. The cap supporting member is supported by the base for pivotal movement about a pivot section. The cap supporting member supports the first cap and the second cap on a surface opposite to the base. The urging member urges the cap supporting member in a direction away from the base. The moving section moves the base relative to the droplet ejecting head, so that one of the first cap and the second cap contacts and separates from the droplet ejecting head. Each of the first cap and the second cap includes a concave section having a concave shape, and a lip section configured to be in contact with the nozzle surface, so as to seal the plurality of nozzles when the moving section moves the base toward the droplet ejecting head. The first cap and the second cap are arranged in the second direction, the first cap being closer to the pivot section than the second cap is. The concave section of the first cap and the concave section of the second cap face different directions from each other. In a state where the second cap seals the plurality of nozzles in the part of the plurality of nozzle arrays, the first cap is spaced away from the droplet ejecting head in such a manner that the lip section of the first cap is gradually away from the nozzle surface toward a pivot section side.

BRIEF DESCRIPTION OF THE DRAWINGS

Embodiments in accordance with the invention will be described in detail with reference to the following figures wherein.

DETAILED DESCRIPTION

A droplet ejecting device according to an embodiment of the invention will be described while referring to FIGS. 1 through 11. The droplet ejecting device of the embodiment is applied to a printer that prints images and the like on printing paper by ejecting ink droplets onto the printing paper from an inkjet head.

In the following description, the expressions "left", "right", "upper", and "lower" are used to define the various parts when the droplet ejecting device is disposed in an orientation in which it is intended to be used.

Figure 1:
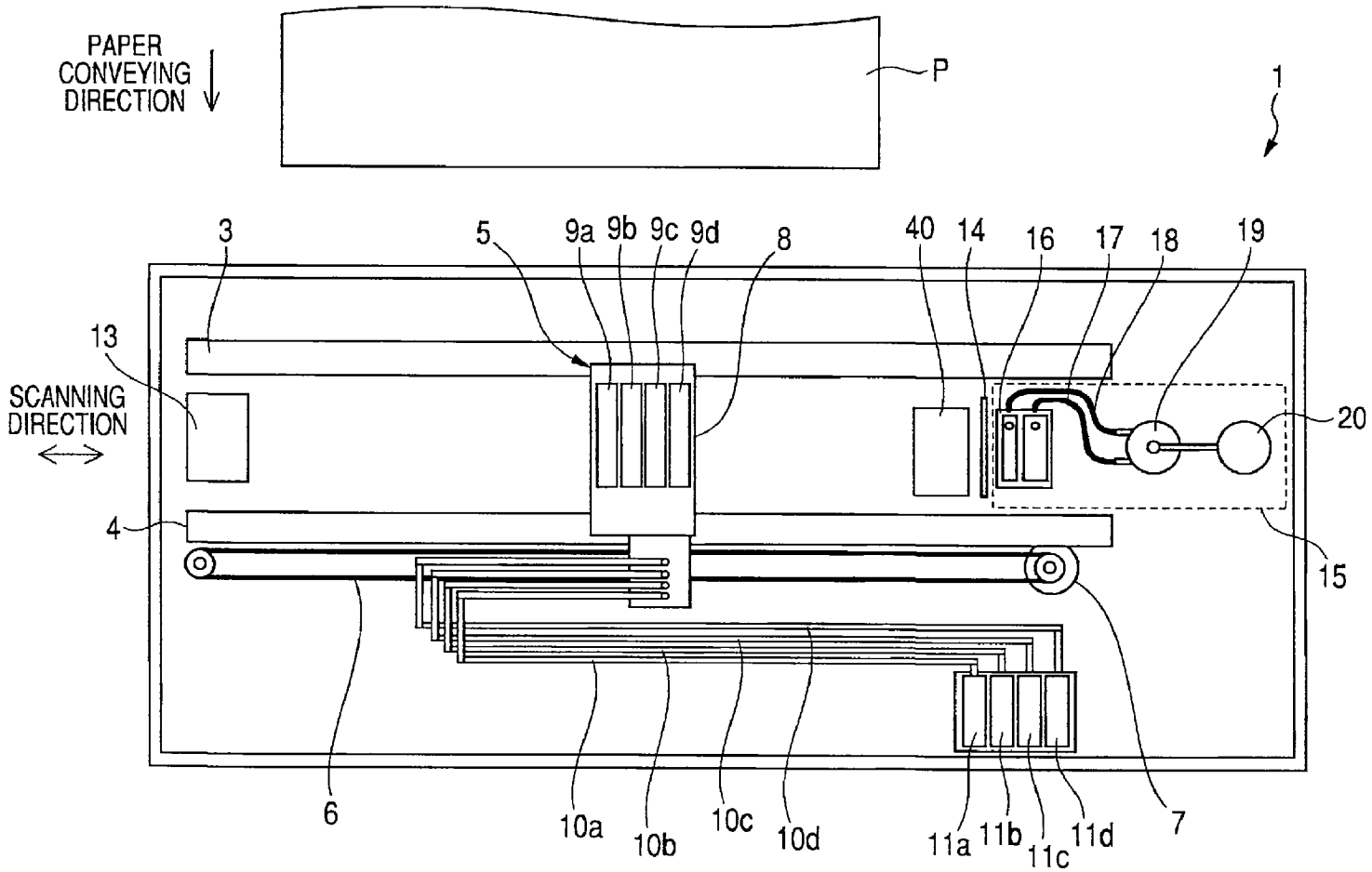
FIG. 1 is a plan view schematically showing the relevant parts of a printer according to an embodiment of the invention.

FIG. 1 is a plan view schematically showing the relevant parts of a printer 1 (droplet ejecting device) according to the embodiment. As shown in FIG. 1, the printer 1 includes a carriage 5 configured to be movable reciprocatingly in one direction, an inkjet head 8 (droplet ejecting head) and subsidiary tanks 9*a*-9*d* both mounted on the carriage 5, ink cartridges 11*a*-11*d* that store ink, and a maintenance unit 15 (liquid sucking section) that recovers ejection performance when the ejection performance of the inkjet head 8 becomes abnormal.

The printer 1 includes two guide frames 3 and 4 that extend in a horizontal direction (the left-right direction in FIG. 1; hereinafter referred to as "scanning direction"). The two guide frames 3 and 4 are arranged with a distance therebetween in a paper conveying direction perpendicular to the scanning direction. The carriage 5 is movably mounted on the guide frames 3 and 4. An endless belt 6 is connected to the carriage 5. When the endless belt 6 is driven to move, the carriage 5 moves in the scanning direction by the movement of the endless belt 6, while being guided by the guide frames 3 and 4.

The inkjet head 8 and the four subsidiary tanks 9*a*-9*d* are mounted on the carriage 5. Nozzles 12 (see FIG. 3) are provided on the lower surface (the surface at the far side of the drawing sheet in FIG. 1) of the inkjet head 8. The inkjet head 8 moves reciprocatingly in the scanning direction together with the carriage 5, while ejecting ink droplets through the nozzles 12 on printing paper P that is conveyed in the paper conveying direction (the up-to-down direction in FIG. 1) by a paper conveying mechanism (not shown). In this way, images and the like are printed on the printing paper P.

The subsidiary tanks 9*a*-9*d* are juxtaposed in the scanning direction. The subsidiary tanks 9*a*-9*d* supply ink to the inkjet head 8 via ink supply ports (not shown) in communication with ink channels formed inside the inkjet head 8. In addition, the subsidiary tanks 9*a*-9*d* are connected to the respective ones of the ink cartridges 11*a*-11*d* via the respective ones of ink tubes 10*a*-10*d*, so that ink can be supplied via the ink tubes 10*a*-10*d*, the ink cartridges 11*a*-11*d* being detachably mounted on the printer 1.

In the printer 1, a waste ink receiver 13, a missing-dot detecting section 40, a wiper 14, and the maintenance unit 15 are provided in regions that do not overlap a region through which printing paper P passes (hereinafter referred to as "print region"). These components are for performing a suction purge operation, a flushing operation, and a wiping operation in order to recover the ejection performance of the inkjet head 8 when the ejection performance of the inkjet head 8 is deteriorated.

The waste ink receiver 13 is for receiving ink droplets ejected from the nozzles 12, in a flushing operation of discharging ink of which viscosity increases as time elapses, thereby recovering the ejection performance. The wiper 14 is for wiping a nozzle surface formed with the nozzles 12, in a wiping operation of removing foreign matters adhering to the periphery of the nozzles 12. The missing-dot detecting section 40 is provided at the left side (in FIG. 1) of the wiper 14. The missing-dot detecting section 40 detects whether ink droplets are normally ejected from the inkjet head 8. The missing-dot detecting section 40 includes a light emitting section (not shown) that emits laser light and a light receiving section (not shown) that receives the laser light emitted from the light emitting section. The above-described print region is located between the missing-dot detecting section 40 and the waste ink receiver 13.

The maintenance unit 15 is used during the suction purge operation, and is provided at the right side (in FIG. 1) of and adjacent to the wiper 14. The maintenance unit 15 includes a suction cap 16 configured to be in close contact with the lower surface (nozzle surface) of the inkjet head 8, cap tubes 17 and 18 each connected to the suction cap 16, and a suction pump 20 that sucks gas within the suction cap 16. The cap tubes 17 and 18 and the suction pump 20 are connected via a switch 19 (switching unit). A control unit 70 (see FIG. 6) of the printer 1 controls the switch 19 to connect either one of the cap tubes 17 and 18 with the suction pump 20.

Figure 2:
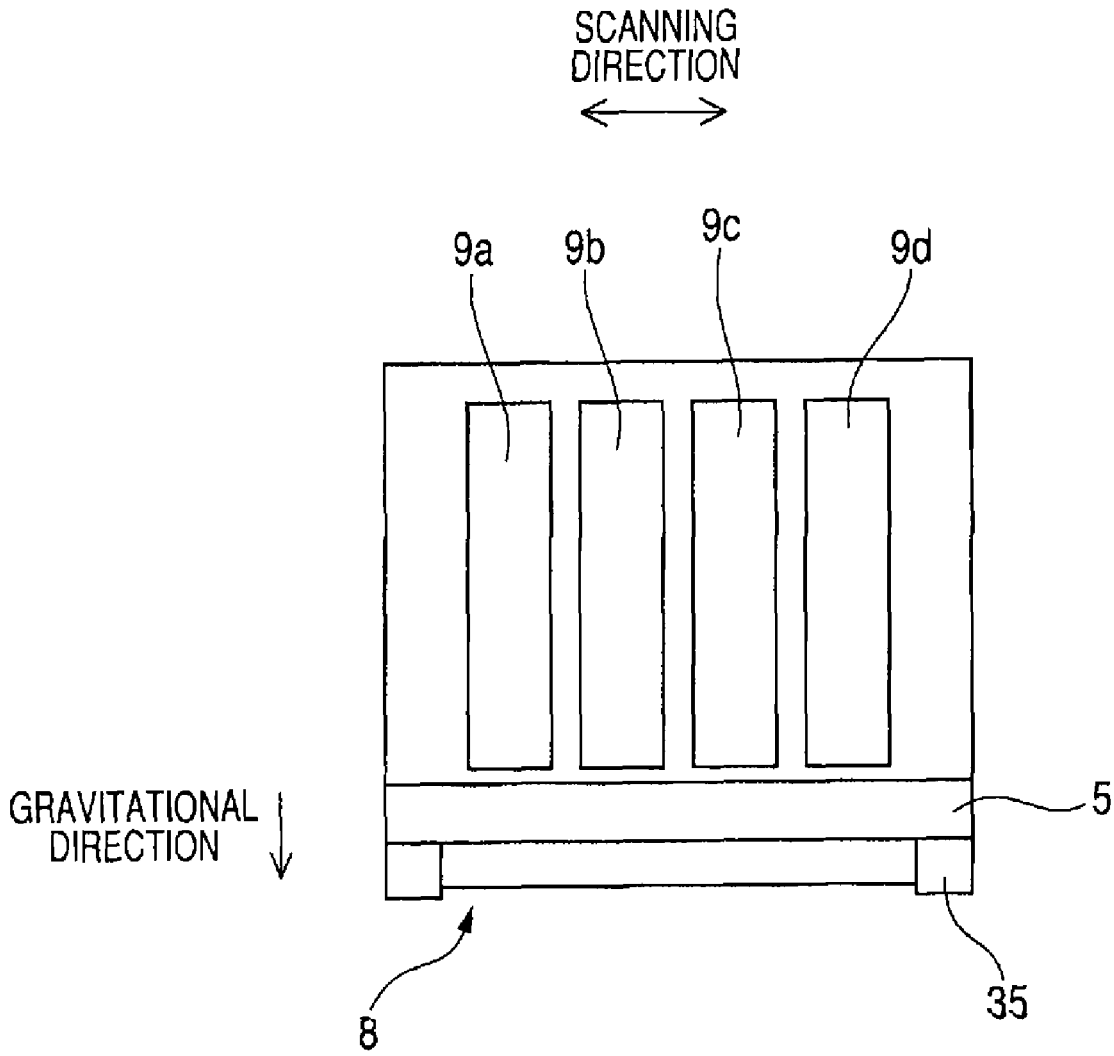
FIG. 2 is a view schematically showing an inkjet head of the printer shown in FIG. 1.
Figure 3:
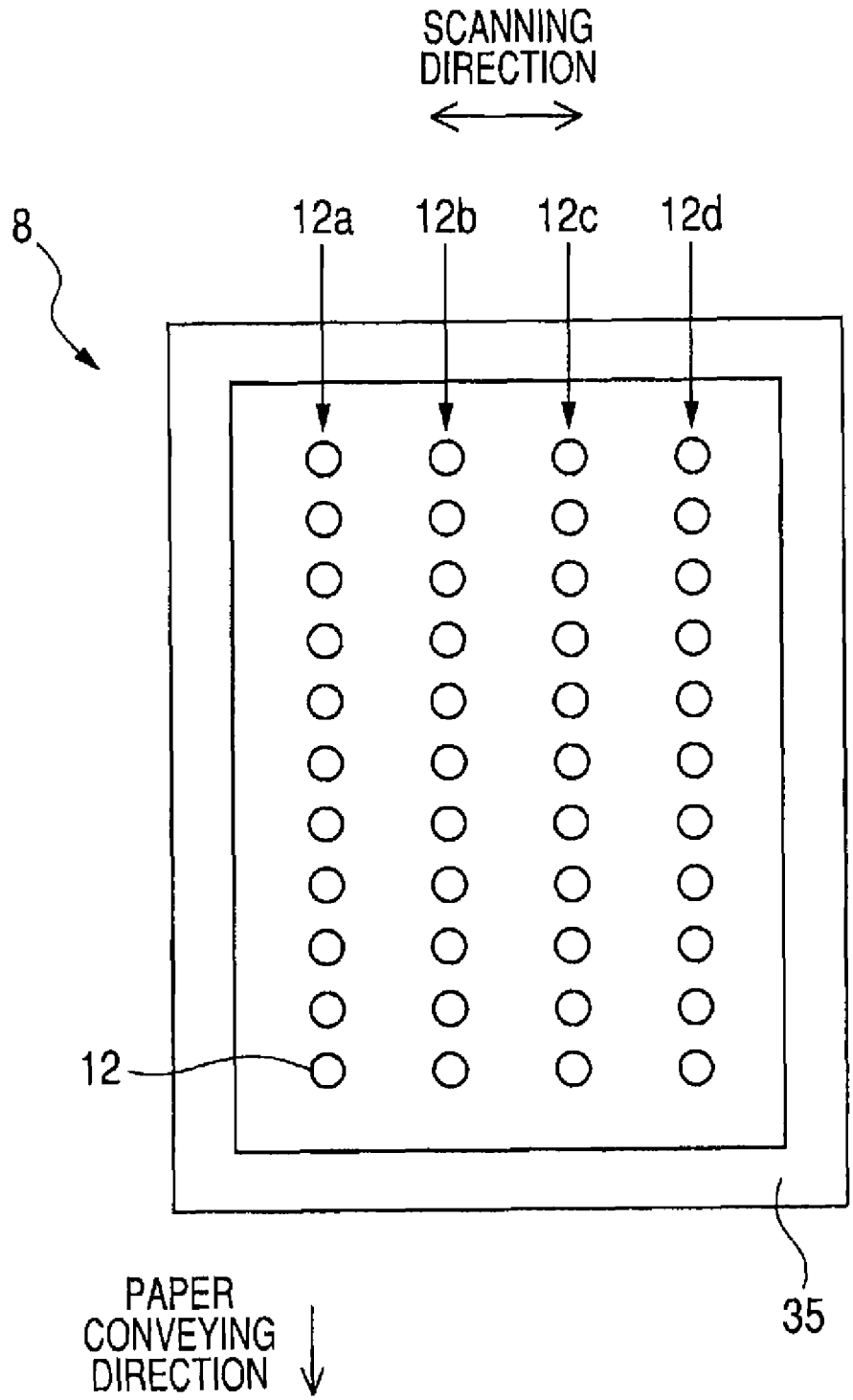
FIG. 3 is a bottom view of the inkjet head shown in FIG. 2.

Next, the inkjet head 8 will be described in detail. FIG. 2 is a cross-sectional view schematically showing the inkjet head 8 including the carriage 5 and the subsidiary tanks 9*a*-9*d*. FIG. 3 is a bottom view of the inkjet head 8.

As shown in FIG. 2, the subsidiary tanks 9*a*-9*d* are mounted on the upper surface of the carriage 5, whereas the inkjet head 8 is mounted on the lower surface of the carriage 5. As described above, the ink channels formed inside the inkjet head 8 are in communication with the subsidiary tanks 9*a*-9*d*, so that ink within the subsidiary tanks 9*a*-9*d* is supplied to the ink channels. Within the ink channels, a pressure applying section 77 (see FIG. 6) is provided for applying pressure to ink within the ink channels in order to eject ink droplets through the nozzles 12. During a printing operation, the control unit 70 (see FIG. 6) of the printer 1 controls the pressure applying section 77 to perform printing.

As shown in FIG. 3, the plurality of nozzles 12 is formed on the lower surface (nozzle surface) of the inkjet head 8, as described above. The plurality of nozzles 12 is arranged in the paper conveying direction to form a nozzle array. In the present embodiment, four nozzle arrays 12*a*-12*d* are arranged in the scanning direction, which is perpendicular to the nozzle alignment direction (paper conveying direction). Further, the four nozzle arrays 12*a*-12*d* are arranged in parallel with each other. For example, the nozzle arrays 12*a*-12*d* eject ink droplets in black, cyan, magenta, and yellow, respectively.

As shown in FIG. 2, a nozzle protecting wall 35 is provided on the lower surface of the carriage 5, the nozzle protecting wall 35 protruding downward from the lower surface of the inkjet head 8. As shown in FIG. 3, the nozzle protecting wall 35 is arranged to surround all of the nozzles 12. With this arrangement, even when printing paper P warps toward the inkjet head 8, the printing paper P contacts the nozzle protecting wall 35 before contacting the lower surface of the inkjet head 8. Hence, the nozzle protecting wall 35 can prevent the printing paper P from contacting the lower surface of the inkjet head 8, thereby protecting the nozzles 12.

Figure 4:
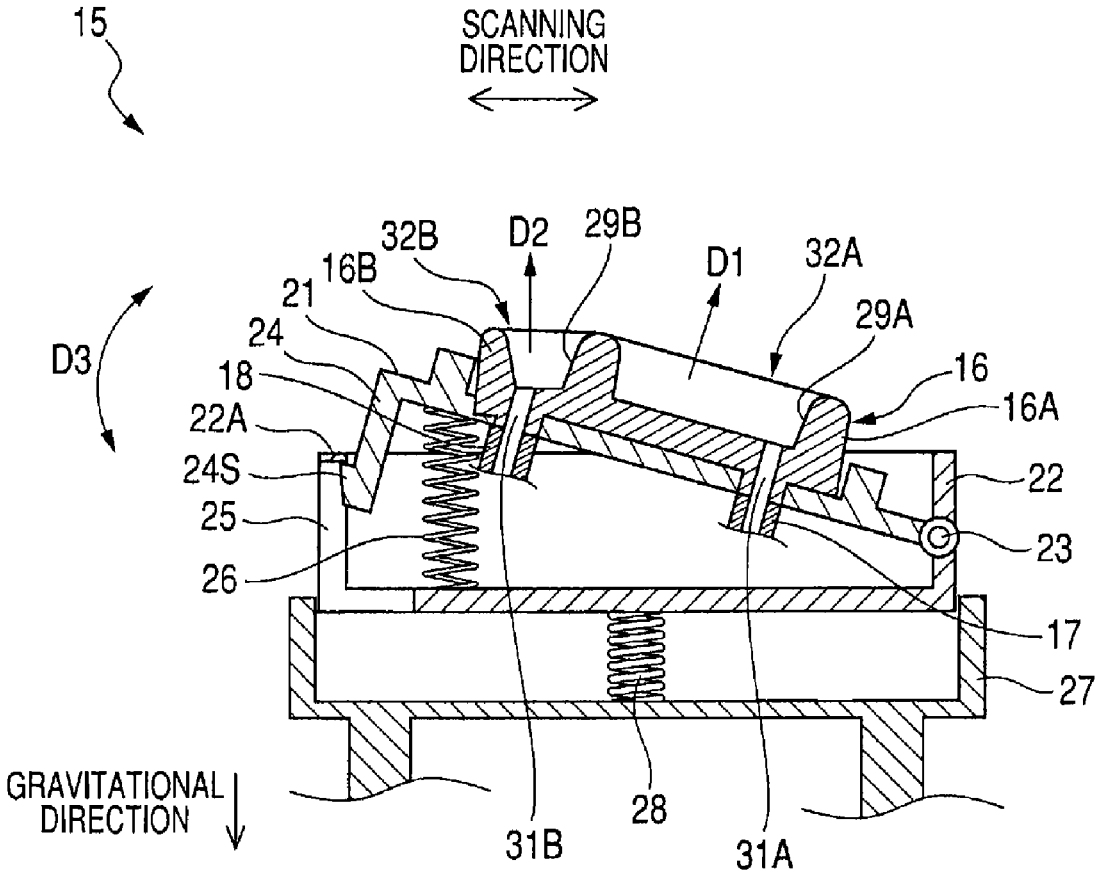
FIG. 4 is a cross-sectional view showing a part of a maintenance unit of the printer shown in FIG. 1.
Figure 5:
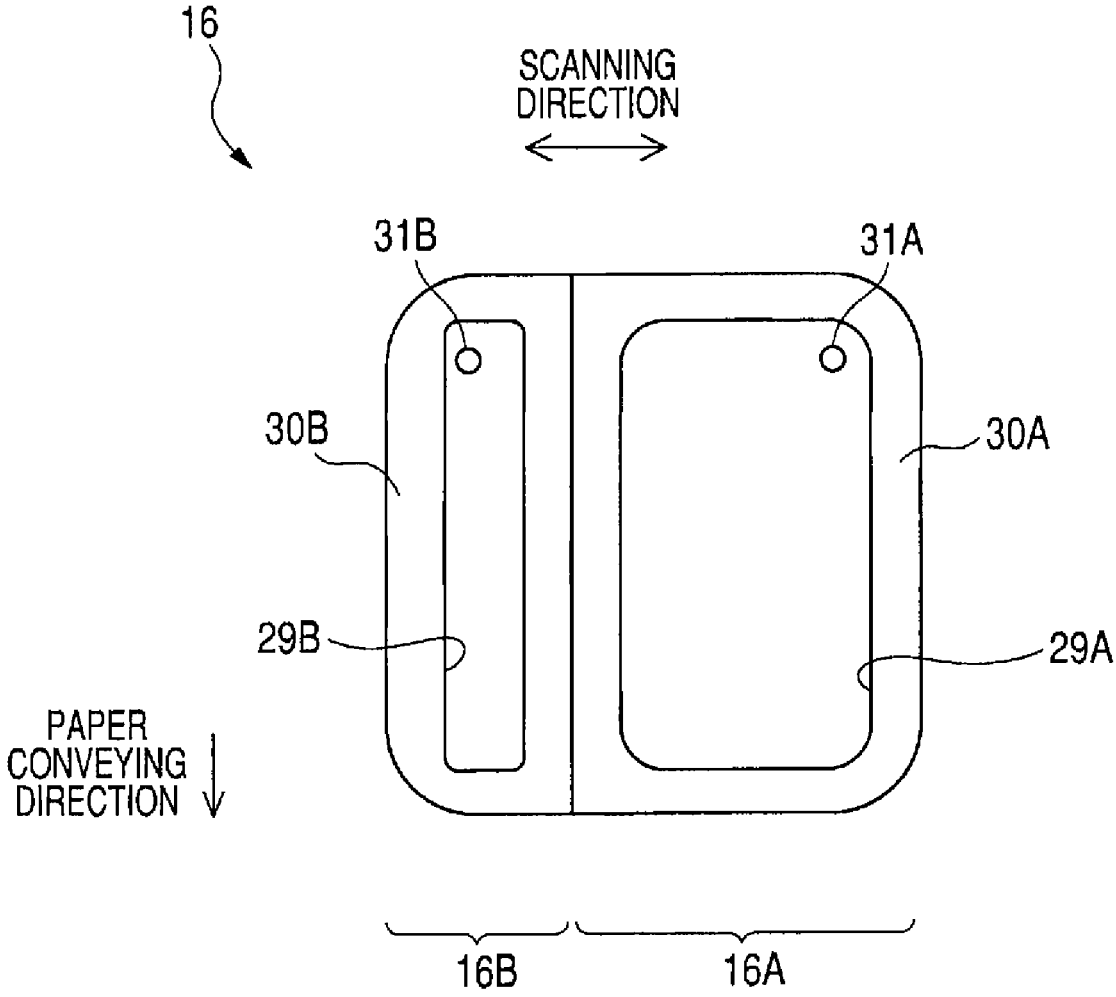
FIG. 5 is an enlarged top view of a suction cap of the maintenance unit shown in FIG. 4.

Next, the maintenance unit 15 will be described with reference to FIGS. 4 and 5. FIG. 4 is a cross-sectional view showing a part of the maintenance unit 15, and showing a state where the maintenance unit 15 is not used. FIG. 5 is an enlarged top view of the suction cap 16 of the maintenance unit 15.

As shown in FIG. 4, the maintenance unit 15 includes the suction cap 16, a cap supporting plate 21 on which the suction cap 16 is mounted, a base 22 pivotally supporting the cap supporting plate 21 via a pivot shaft 23, and a seat 27 provided at the lower side (the lower side in FIG. 4) of the base 22. The pivot shaft 23 extends in a direction in which the plurality of nozzles in each nozzle array is aligned.

The cap supporting plate 21 is a plate-shaped member made of resin or the like. The cap supporting plate 21 supports the suction cap 16 on the surface in confrontation with the inkjet head 8. The base 22 is located at the side opposite to the suction cap 16 with respect to the cap supporting plate 21. One end side (the right side in FIG. 4) of the cap supporting plate 21 is connected to the base 22 via the pivot shaft 23, so that the cap supporting plate 21 can swing relative to the base 22. On the other hand, a guide member 24 is provided at another end side (the left side in FIG. 4) of the cap supporting plate 21, the guide member 24 extending downwardly toward the base 22 side and substantially perpendicular to the main plate of the cap supporting plate 21. The guide member 24 has a stopper section 24S at its distal end. The stopper section 24S is a substantially triangular protrusion. The stopper section 24S is fitted in a guide hole 25 formed in the base 22. The guide hole 25 extends in the base 22 in the up-down direction to reach the bottom section of the base 22, so that guide hole 25 can guide the guide member 24 within a range where the hole is formed.

The base 22 is made of resin or the like, and has a substantially concave box-like shape. The cap supporting plate 21 is located in the opening of the base 22, whereas the seat 27 is located at the side opposite to the opening of the base 22. A compression spring 26 (urging member) is provided between the cap supporting plate 21 and the base 22. The compression spring 26 is located between the one end (the right end) and the other end (the left end) of the cap supporting plate 21. In a state where the cap supporting plate 21 and the base 22 are farthest away from each other (the state shown in FIG. 4), the compression spring 26 is in a compressed state with respect to its natural length. Thus, because the compression spring 26 is always in a compressed state to generate restoring force due to compression, the restoring force acts both on the cap supporting plate 21 and on the base 22, thereby urging the cap supporting plate 21 away from the base 22. Further, the compression spring 26 urges the cap supporting plate 21, so that the stopper section 24S of the guide member 24 contacts an upper end section 22A of the guide hole 25. With this arrangement, the cap supporting plate 21 can be kept to a predetermined orientation at the time when the maintenance unit 15 is not used (the state shown in FIG. 4).

The seat 27 is made of resin or the like, and has a substantially box-like shape formed with a concave section. The seat 27 has a surface in confrontation with the base 22 (the inner bottom surface of the concave section of the seat 27), the surface being parallel with the lower surface of the inkjet head 8. A bottom part of the base 22 is fitted in the concave section of the seat 27. A compression spring 28 is provided between the base 22 and the seat 27. The compression spring 28 has a spring constant greater than the spring constant of the compression spring 26. Thus, at the time when the maintenance unit 15 is not used, the compression spring 28 is in its natural length or is merely slightly compressed to such an extent that restoring force is not generated. In addition, the base 22 is arranged to fit in the concave section of the seat 27. Thus, even when the base 22 is tilted in the left or right direction (the left or right direction in FIG. 4), the base 22 contacts the inner surface of the concave section of the seat 27. Hence, because the orientation of the base 22 can be kept constantly, the suction cap 16 can be held relative to the inkjet head 8.

Figure 6:
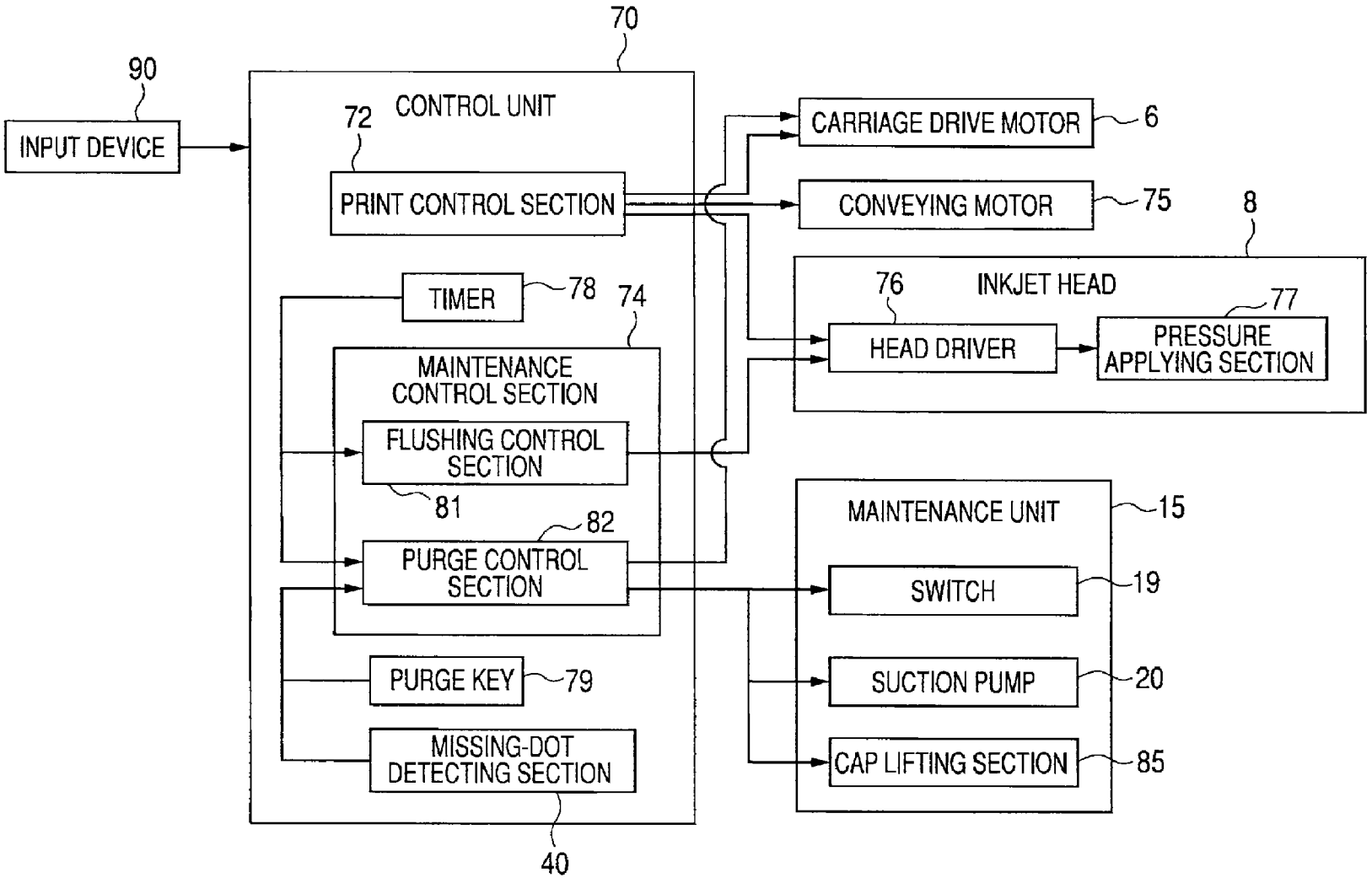
FIG. 6 is a block diagram schematically showing the electrical configuration of the printer.

The seat 27 is connected to a cap lifting section 85 (see FIG. 6). The cap lifting section 85 is for moving the seat 27 up and down (the upward and downward directions in FIG. 4). At the maintenance operation, the cap lifting section 85 moves the seat 27 upward, so that the suction cap 16 moves closer to the inkjet head 8. When the maintenance operation ends, the cap lifting section 85 moves the seat 27 downward, so that the suction cap 16 moves away from the inkjet head 8.

Next, the suction cap 16 will be described in detail. As shown in FIG. 5, the suction cap 16 includes a first cap section 16A and a second cap section 16B. The suction cap 16 is formed with two concave sections 29A and 29B in the first and second cap sections 16A and 16B, respectively. The suction cap 16 has a lip 30A defining the concave section 29A and a lip 30B defining the concave section 29B. In addition, communication holes 31A and 31B are formed in the inner bottom surfaces of the concave sections 29A and 29B, respectively.

As shown in FIG. 4, both of the concave sections 29A and 29B are opened in the upward direction (the upward direction in FIG. 4), the upward direction being opposite to the cap supporting plate 21. The concave sections 29A and 29B are arranged in the scanning direction. As shown in FIG. 5, each of the concave sections 29A and 29B extends in the paper conveying direction. The lengths of the concave sections 29A and 29B in the paper conveying direction are the same. The concave section 29A has such a width (in the left-right direction in FIG. 5) that can cover all of the nozzle arrays 12*a*-12*d*. In contrast, the concave section 29B has such a width that can cover only one of the nozzle arrays 12*a*-12*d*.

The lips 30A and 30B define the concave sections 29A and 29B, respectively, as described above. Either one of the lips 30A and 30B contacts the lower surface of the inkjet head 8 during the maintenance operation. That is, the lips 30A and 30B are configured in such a manner that, when one of the lips 30A and 30B is in contact with the lower surface of the inkjet head 8, the other one is not in contact with the lower surface of the inkjet head 8. During the maintenance operation, the entire region of either one of the lips 30A and 30B contacts the lower surface of the inkjet head 8, thereby sealing the nozzles 12. Here, a sealing surface 32A (opening surface) is defined as the surface including both the part of the lip 30A in contact with the lower surface of the inkjet head 8 and the opening of the concave section 29A, in a state where the nozzles 12 are sealed. Similarly, a sealing surface 32B (opening surface) is defined as the surface including both the part of the lip 30B in contact with the lower surface of the inkjet head 8 and the opening of the concave section 29B. Further, an opening direction D1 of the concave section 29A is defined as the direction perpendicular to the sealing surface 32A and directing from the concave section 29A toward the outside. Similarly, an opening direction D2 of the concave section 29B is defined as the direction perpendicular to the sealing surface 32B and directing from the concave section 29B toward the outside. Here, the opening directions D1 and D2 are directed in different directions, so that the opening directions D1 and D2 are away from each other (i.e., the opening directions D1 and D2 do not come closer to each other). As shown in FIG. 5, the first cap section 16A (first suction cap) of the suction cap 16 includes: the concave section 29A that covers and seals the nozzles 12; and the lip 30A configured to be in close contact with the lower surface of the inkjet head 8. Similarly, the second cap section 16B (second suction cap) of the suction cap 16 includes the concave section 29B and the lip 30B.

As shown in FIGS. 4 and 5, the communication holes 31A and 31B are formed in the inner bottom surfaces of the concave sections 29A and 29B, respectively, and are in communication with the cap tubes 17 and 18, respectively. As shown in FIG. 4, the communication hole 31A is formed at the pivot shaft 23 side (the right side in FIG. 5) in the bottom surface of the concave section 29A. The communication hole 31B is formed at the guide member 24 side (the left side in FIG. 5) in the bottom surface of the concave section 29B.

The operations of the maintenance unit 15 having the above-described configuration will be described. During the maintenance operation, the cap lifting section 85 (see FIG. 6) of the maintenance unit 15 moves the seat 27 upwardly toward the inkjet head 8 until the suction cap 16 is in contact with the lower surface of the inkjet head 8.

Because the cap supporting plate 21 supporting the suction cap 16 is pivotally supported by the base 22 at one end, the cap supporting plate 21 can pivotally move about the pivot shaft 23 in clockwise and counterclockwise directions in FIG. 4. Here, a circumferential direction D3 is defined as the direction perpendicular to the surface of the cap supporting plate 21 on which the suction cap 16 is mounted, the circumferential direction D3 being the direction about the pivot shaft 23. As described above, the opening direction D1 of the first cap section 16A and the opening direction D2 of the second cap section 16B are directed in different directions. Thus, when the suction cap 16 is positioned in such a manner that either one of the opening directions D1 and D2 is perpendicular to the lower surface of the inkjet head 8, the other one of the opening directions D1 and D2 is not perpendicular to the lower surface of the inkjet head 8. Accordingly, when the second cap section 16B is in contact with the lower surface of the inkjet head 8, the first cap section 16A is not in contact with the lower surface of the inkjet head 8. At this time, the compression spring 26 is compressed to make the second cap section 16B in contact with the lower surface of the inkjet head 8. On the other hand, when the second cap section 16B seals the nozzles 12, the compression spring 28 is compressed only slightly and does not generate force of urging the base 22. However, the contact area of the second cap section 16B is smaller than the contact area of the first cap section 16A. Thus, if a certain degree of urging force acting on the second cap section 16B is ensured, the second cap section 16B can seal the nozzles 12 reliably.

By moving the cap supporting plate 21 in the circumferential direction D3 to change the orientation of the suction cap 16, either one of the first cap section 16A and the second cap section 16B can confront the lower surface of the inkjet head 8. With this movement, either one of the first cap section 16A and the second cap section 16B can be selected for sealing the nozzles 12. Further, when the first cap section 16A is used, the cap supporting plate 21 is moved closer to the base 22, compared with the case when the second cap section 16B is used. Hence, the distance between the seat 27 and the inkjet head 8 becomes smaller, and the compression spring 28 is compressed as well as the compression spring 26. At this time, because the restoring force of the compression spring 28 acts to urge the base 22, the sealing force of the first cap section 16A can be increased. Hence, when using the first cap section 16A having a large contact area with the lower surface of the inkjet head 8, the urging force can be made larger to increase the sealing force. Thus, the sealing force of the first cap section 16A can be ensured reliably.

Because the cap supporting plate 21 pivotally moves in the circumferential direction D3, the sealing force of the first cap section 16A or the second cap section 16B acts in a direction which is not perpendicular to the lower surface of the inkjet head 8. In other words, a force component along the lower surface of the inkjet head 8 may cause the suction cap 16 to slip on the lower surface, failing to obtain sufficient sealing performance. However, because the restoring force of the compression spring 28 acts in the direction perpendicular to the lower surface of the inkjet head 8, the first cap section 16A and the second cap section 16B can be urged in the direction perpendicular to the lower surface of the inkjet head 8. Because the urging force of both the compression spring 26 and the compression spring 28 is applied to the cap supporting plate 21, the force component along the lower surface of the inkjet head 8 is alleviated. Thus, either the first cap section 16A or the second cap section 16B can be pressed reliably against the lower surface of the inkjet head 8. The controls of the maintenance unit 15 for selecting either the first cap section 16A or the second cap section 16B will be described later in detail.

Next, the electrical configuration of the printer 1 will be described with reference to FIG. 6. FIG. 6 is a block diagram schematically showing the electrical configuration of the printer 1. The control unit 70 shown in FIG. 6 includes a CPU (Central Processing Unit), a ROM (Read Only Memory) that stores various programs, data, etc. for controlling the overall operations of the printer 1, a RAM (Random Access Memory) that temporarily stores data etc. processed by the CPU.

As shown in FIG. 6, the control unit 70 includes a print control section 72 and a maintenance control section 74. The print control section 72 controls printing performed on printing paper P. The maintenance control section 74 controls a maintenance operation and the like of the inkjet head 8. The CPU executes various control programs stored in the ROM to implement the functions of the print control section 72 and the maintenance control section 74. In addition, the CPU is connected to each of a timer 78 that counts (measures) elapsed time since the previous maintenance operation, a purge key 79 provided on the main body of the printer 1, and the missing-dot detecting section 40 provided within the main body of the printer 1. The CPU selects various control programs in response to signals transmitted from each of the above-mentioned timer 78, the purge key 79, and the missing-dot detecting section 40, and operates the print control section 72 and the maintenance control section 74.

The print control section 72 controls each of the carriage drive motor 6 that drives the carriage 5 in a reciprocating motion, a conveying motor 75 that drives a paper conveying mechanism (not shown) to convey printing paper P, and a head driver 76 that drives the pressure applying section 77 of the inkjet head 8, based on data inputted from an input device 90 such as a personal computer, thereby printing an image and the like on the printing paper P.

The maintenance control section 74 includes a flushing control section 81 and a purge control section 82. The flushing control section 81 controls the head driver 76 to drive the pressure applying section 77 to apply pressure to ink within the pressure chamber (ink chamber), thereby performing a flushing operation during which ink droplets are ejected continuously a plurality of times from the nozzles 12 of the inkjet head 8. The flushing control section 81 may be controlled to change the number of times of ejecting ink droplets during the flushing operation, based on the time measured by the timer 78.

The purge control section 82 is connected to each of the timer 78, the purge key 79, and the missing-dot detecting section 40, and receives signals transmitted therefrom. The purge control section 82 is also connected to each of the maintenance unit 15 and the carriage drive motor 6. The maintenance unit 15 includes the switch 19, the suction pump 20, and the cap lifting section 85. The purge control section 82 drives the switch 19, the suction pump 20, and the cap lifting section 85, based on signals transmitted from the timer 78, the purge key 79, and the missing-dot detecting section 40. The cap lifting section 85 is implemented by known mechanisms such as a cam mechanism, a link mechanism, a mechanism using a solenoid, and a combination thereof.

Figure 7:
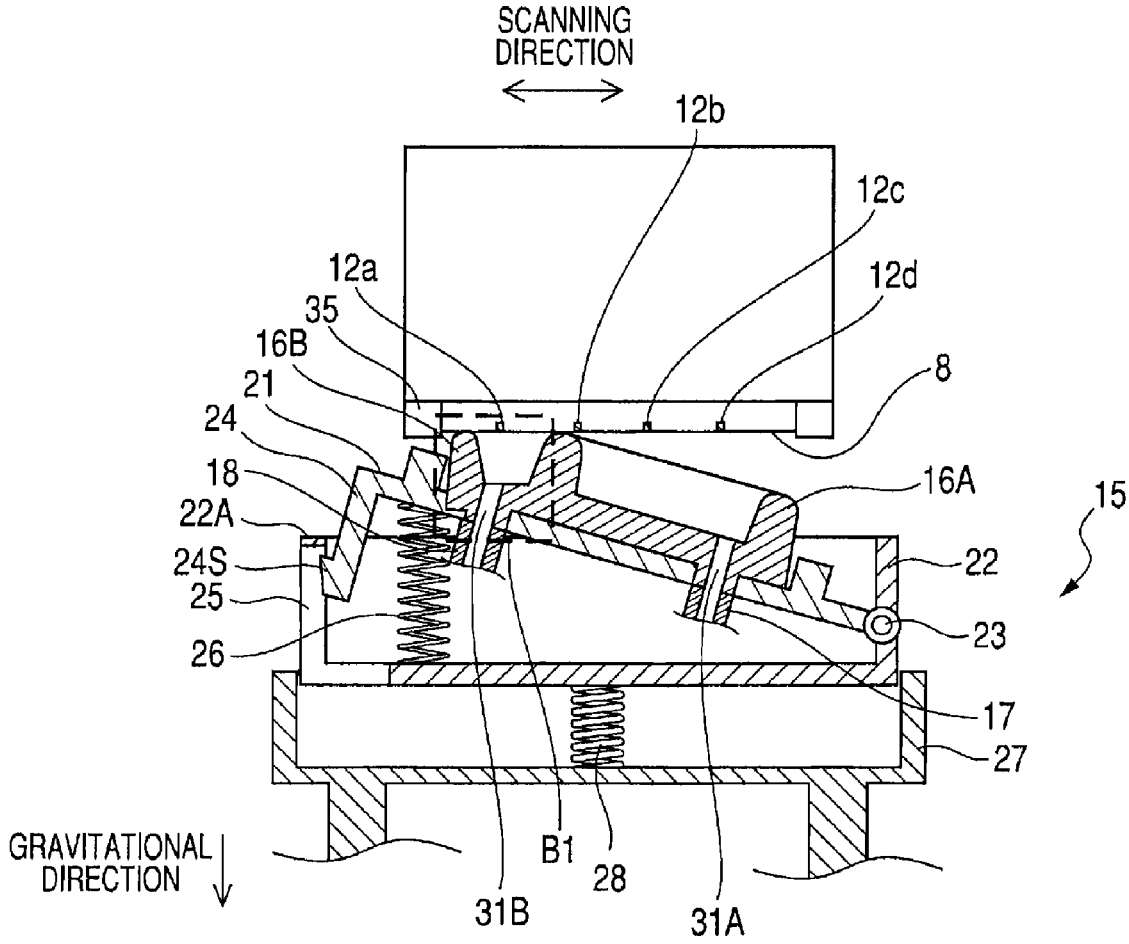
FIG. 7 is a cross-sectional view showing the part of the maintenance unit during a maintenance operation in which a second cap section is used.
Figure 8:
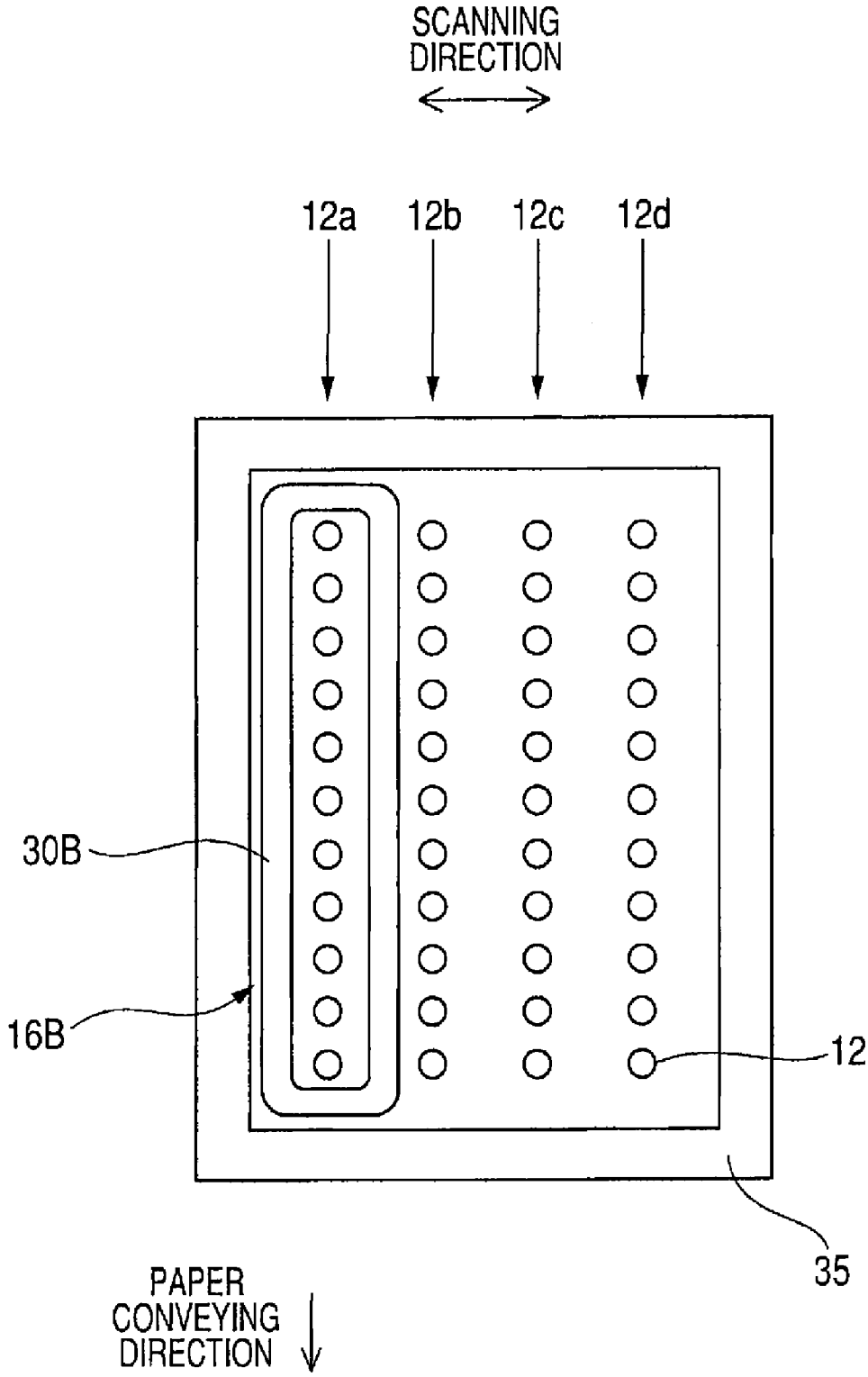
FIG. 8 is a bottom view schematically showing the inkjet head in a state shown in FIG. 7.
Figure 9:
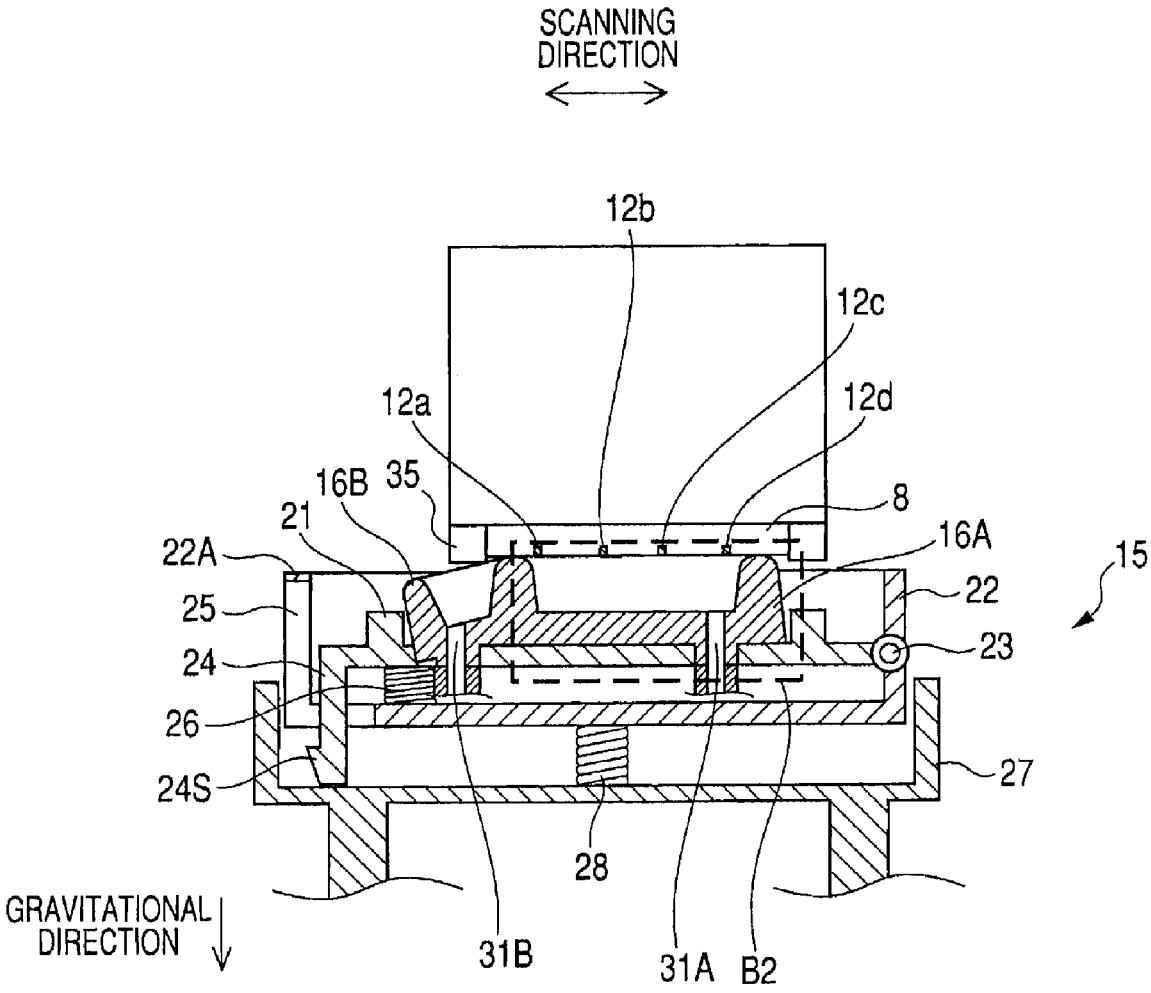
FIG. 9 is a cross-sectional view showing the part of the maintenance unit during a maintenance operation in which a first cap section is used.
Figure 10:
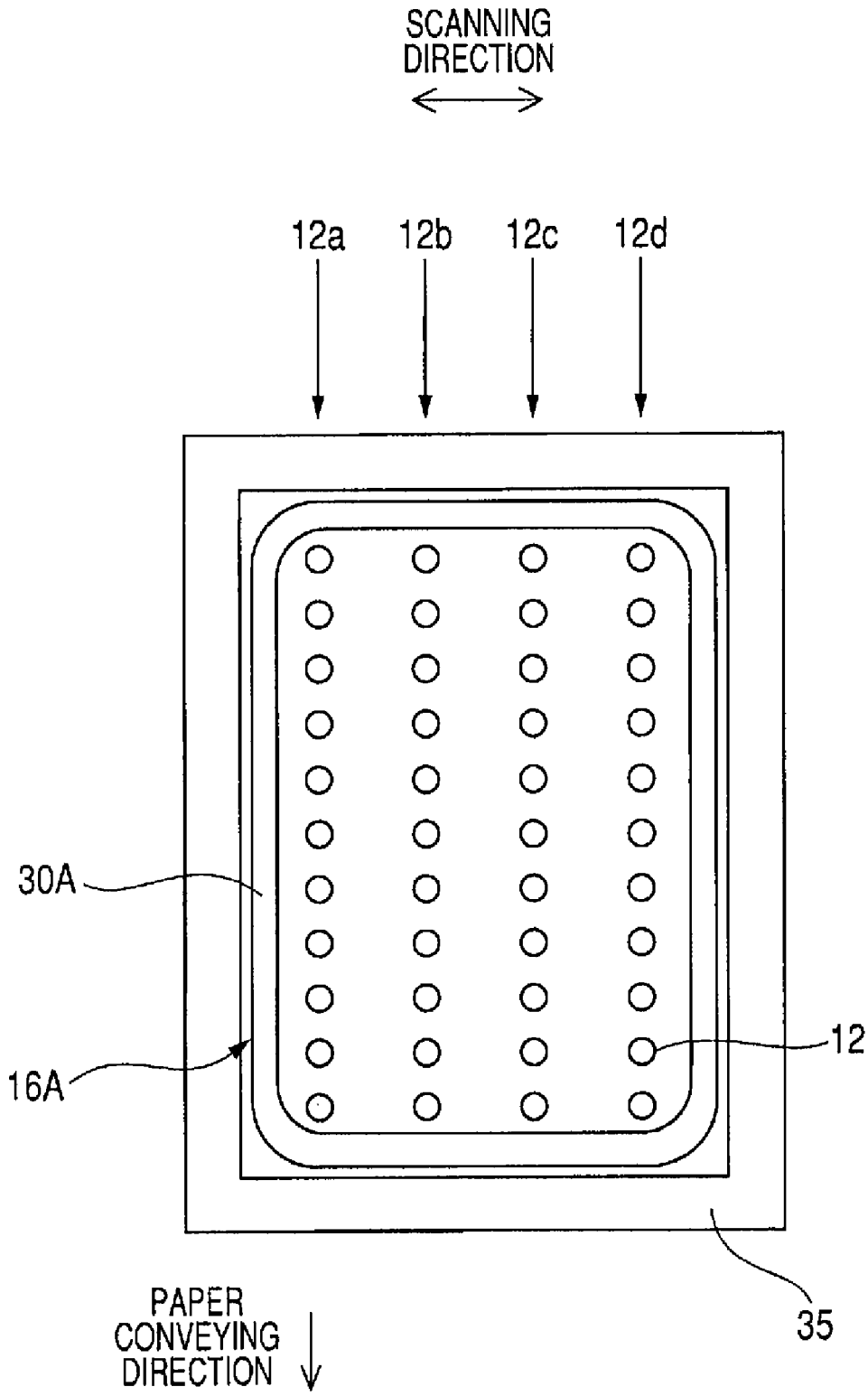
FIG. 10 is a bottom view schematically showing the inkjet head in a state shown in FIG. 9.

The controls by the purge control section 82 for performing a purge operation will be described with reference to FIGS. 7 through 10. FIG. 7 shows a case where a purge operation is performed for only one of the nozzle arrays 12*a*-12*d*. FIG. 8 is a bottom view schematically showing the lower surface of the inkjet head 8 in the case of FIG. 7. In contrast, FIG. 9 shows a case where a purge operation is performed for all of the nozzle arrays 12*a*-12*d*. FIG. 10 is a bottom view schematically showing the lower surface of the inkjet head 8 in the case of FIG. 9.

The purge control section 82 controls each of the switch 19 that connects either one of the first cap section 16A and the second cap section 16B with the suction pump 20, the cap lifting section 85 that is connected to the seat 27 and that moves the seat 27 up and down, and the suction pump 20, thereby performing a suction purge operation.

Further, the purge control section 82 determines the nozzle arrays 12*a*-12*d* for which the suction purge operation is to be performed based on signals transmitted from the timer 78, the purge key 79, the missing-dot detecting section 40, and controls the maintenance unit 15. For example, if one nozzle with a missing dot is detected or if a plurality of nozzles with missing dots in a single nozzle array is detected, the purge control section 82 drives the carriage drive motor 6 to move the inkjet head 8, so that the second cap section 16B confronts the nozzle array in which a nozzle with a missing dot is detected. This positioning of the inkjet head 8 is controlled by using an optical sensor (not shown) provided on the carriage 5 and an encoder (not shown) provided in the main body of the printer 1.

When the purge operation is performed only for a single nozzle array (the nozzle array 12*a* in this example), as shown in FIG. 7, the suction cap 16 is positioned so that only the second cap section 16B is in contact with the inkjet head 8. In order to position the second cap section 16B at this position, the purge control section 82 controls the cap lifting section 85 to move up the seat 27 to such a position that only the second cap section 16B is in contact with the lower surface (nozzle surface) of the inkjet head 8. At this time, as shown in FIG. 8, the second cap section 16B can seal the single nozzle array (the nozzle array 12*a* in this example) without contacting the nozzle protecting wall 35. Further, because only the second cap section 16B contacts the nozzle surface to seal the single nozzle array, a constant sealing area can always be ensured regardless of which nozzle array is sealed. Note that, a bracket B1 in FIG. 7 indicates a section sealed by the second cap section 16B.

In contrast, when the purge operation is performed for all of the nozzle arrays 12*a*-12*d*, as shown in FIG. 9, the suction cap 16 is positioned so that only the first cap section 16A is in contact with the inkjet head 8. More specifically, from a state shown in FIG. 7 where the second cap section 16B is in contact with the inkjet head 8, the purge control section 82 controls the cap lifting section 85 to further move up the seat 27. At this time, the distance between the inkjet head 8 and the seat 27 decreases, causing the inkjet head 8 to press the second cap section 16B downward. Then, as the distance further decreases, the compression spring 26 cannot maintain its length and is compressed. At the same time, the cap supporting plate 21 pivotally moves about the pivot shaft 23 in the direction toward the base 22. With this movement, the suction cap 16 shifts from the orientation shown in FIG. 7 to such an orientation that the first cap section 16A covers the inkjet head 8. Then, when the cap supporting plate 21 reaches the position shown in FIG. 9, the upward movement of the seat 27 is stopped. As shown in FIGS. 9 and 10, the first cap section 16A can seal the nozzle arrays 12*a*-12*d* without contacting the nozzle protecting wall 35. Note that, a bracket B2 in FIG. 9 indicates a section sealed by the first cap section 16A.

With the above-described arrangement, in order to seal the nozzles 12 by selecting either one of the first cap section 16A and the second cap section 16B, first, the purge control section 82 controls the carriage drive motor 6 to move the carriage 5 to such a position that the cap section to be used (either the first cap section 16A or the second cap section 16B) is in confrontation with the nozzles to be purged. Thereafter, by moving the seat 27 up or down using the cap lifting section 85, the orientation of the cap supporting plate 21 can be changed so that either one of the first cap section 16A and the second cap section 16B confronts the lower surface of the inkjet head 8. In addition, by providing an optical sensor (not shown) to the seat 27 and by calculating the height (the position in the gravitational direction) of the seat 27, the cap lifting section 85 can be controlled to position the seat 27 accurately.

In the present embodiment, the purge control section 82 and the cap lifting section 85 function as a moving section that moves the base 22 relative to the inkjet head 8 by moving the seat 27. The purge control section 82, the cap lifting section 85, the base 22, the cap supporting plate 21, and the compression spring 26 function as a selecting section. The suction cap 16, the cap supporting plate 21, the base 22, the compression spring 26, the purge control section 82, the cap lifting section 85, the cap tubes 17 and 18, the switch 19, and the suction pump 20 function as a liquid sucking section.

Next, the operation of the maintenance unit 15 according to the present embodiment will be described with reference to FIG. 11, wherein the second cap section 16B is used.

Figure 11:
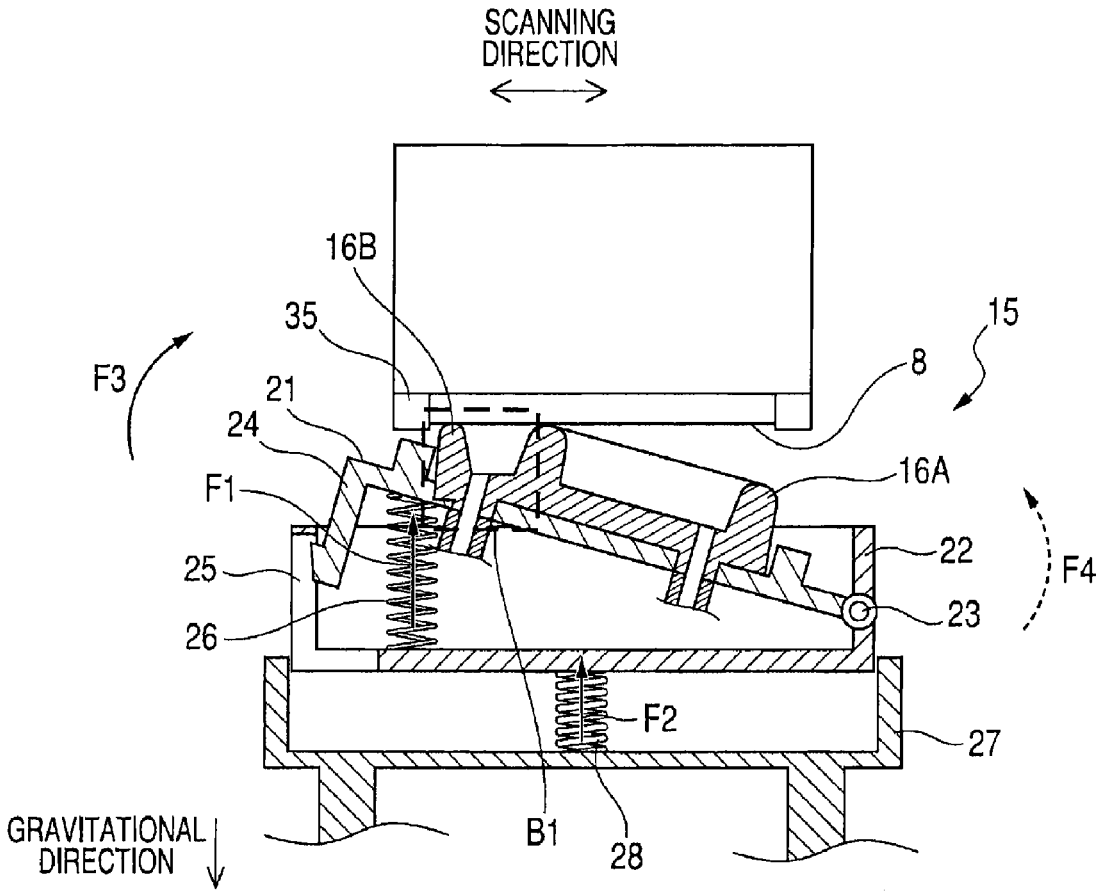
FIG. 11 is a cross-sectional view showing the part of the maintenance unit in a state shown in FIG. 7, and particularly showing various forces acting on the maintenance unit.

As shown in FIG. 11, when the second cap section 16B is in close contact with the inkjet head 8, the second cap section 16B confronts the inkjet head 8 and covers the nozzles 12. When the second cap section 16B is in close contact with the inkjet head 8, the compression spring 26 is compressed to generate restoring force F1. However, because the compression spring 28 has a spring constant greater than the spring constant of the compression spring 26, the compression spring 28 is compressed only slightly. Hence, restoring force F2 generated by compression of the compression spring 28 is small. Further, the restoring force F1 generates rotational force F3 of rotating (pivoting) the cap supporting plate 21 about the pivot shaft 23 toward the lower surface of the inkjet head 8. The rotational force F3 accounts for a large part of the sealing force of the second cap section 16B. This suppresses that unnecessary force is applied to the second cap section 16B.

When the second cap section 16B seals the nozzles 12, the rotational force F3 of rotating the cap supporting plate 21 about the pivot shaft 23 is greater than the restoring force F2 which acts perpendicularly on the lower surface of the inkjet head 8. Further, when the second cap section 16B is in close contact with the lower surface of the inkjet head 8, the restoring force F2 acts on the center of the suction cap 16, which generates rotational force F4 that rotates the cap supporting plate 21 with the second cap section 16B as the fulcrum. The rotational force F4 acts in such a manner that the lip 30B (see FIG. 5) of the second cap section 16B at the left side (in FIG. 11) separates from the lower surface of the inkjet head 8. However, with the maintenance unit 15 of the present embodiment, the rotational force F3 is greater than the rotational force F4 when the second cap section 16B seals the nozzles 12. This suppresses that the cap supporting plate 21 moves in the direction of the rotational force F4. Accordingly, even when the nozzle array to be sealed is changed, the second cap section 16B can be prevented from rotating (pivoting) to separate from the lower surface of the inkjet head 8, thereby sealing the nozzle array reliably.

With the above-described printer 1, the following advantageous effects can be obtained.

The maintenance unit 15 includes the suction cap 16 having: the first cap section 16A capable of sealing all of the nozzle arrays 12*a*-12*d* and facing the opening direction D1; and the second cap section 16B capable of sealing one of the nozzle arrays 12*a*-12*d* and facing the opening direction D2 different from the opening direction D1. The maintenance unit 15 further includes the cap supporting plate 21 supporting the suction cap 16, the base 22 pivotally supporting the cap supporting plate 21 with the pivot shaft 23, the compression spring 26 arranged between the base 22 and the cap supporting plate 21, and the cap lifting section 85 that moves the base 22 relative to the inkjet head 8. When the second cap section 16B seals one of the nozzle arrays 12*a*-12*d*, the first cap section 16A is spaced away from the inkjet head 8. That is, when the second cap section 16B seals one of the nozzle arrays 12*a*-12*d*, only the second cap section 16B is in contact with the lower surface of the inkjet head 8. Hence, regardless of which nozzle array is sealed, the contact area between the inkjet head 8 and the second cap section 16B can be made constant. Thus, the sealing force can also be made constant, and it is unnecessary to consider changes in the contact area between the suction cap and the inkjet head depending on which nozzle array is sealed. Whichever nozzle array is to be sealed, the second cap section 16B can seal any one of the nozzle arrays 12*a*-12*d* reliably.

Further, the cap supporting plate 21 is supported by the base 22 for pivotal movement about the pivot shaft 23, and is movable only in the circumferential direction D3 shown in FIG. 4. Thus, the restoring force F1 of the compression spring 26 provided between the cap supporting plate 21 and the base 22 urges the cap supporting plate 21 so as to generate the rotational force F3 (see FIG. 11) in the circumferential direction D3 (see FIG. 4) in the clockwise direction. At this time, because the pivot shaft 23 prevents the right end (in FIG. 11) of the cap supporting plate 21 from moving upward, the rotational force F4 (see FIG. 11) in the circumferential direction D3 in the counterclockwise direction is not applied to the cap supporting plate 21. Hence, the second cap section 16B can be in contact with the lower surface of the inkjet head 8 with constant pressing force. Thus, when the second cap section 16B is used, the nozzle array can be sealed reliably.

Further, when the seat 27 is lowered to move the maintenance unit 15 to a standby position after the first cap section 16A is used, as shown in FIG. 4, the left side of the cap supporting plate 21 moves upward. In the standby position, the seat 27 and the base 22 are lowered so that both of the first cap section 16A and the second cap section 16B are spaced away from the lower surface of the inkjet head 8. In this state, the communication hole 31A of the first cap section 16A is located at the lowest position in the bottom surface of the concave section 29A. With this arrangement, even if ink remains in the concave section 29A, the ink can be discharged through the communication hole 31A in communication with the cap tube 17. Accordingly, the ink in the concave section 29A can be discharged reliably at the time when the maintenance unit 15 is not used. That is, the ink in the first cap section 16A can be discharged with a minimum configuration and operation, without special configuration or operation. As to the second cap section 16B, the bottom surface of the concave section 29B is located to be horizontal at the time when the maintenance unit 15 is not used (the state shown in FIG. 4). Thus, although it is relatively difficult to discharge ink through the communication hole 31B compared with the concave section 29A, the communication hole 31B never becomes higher than the other part of the bottom surface of the concave section 29B, which prevents a large amount of ink from remaining in the concave section 29B. In addition, in a state where the first cap section 16A is in contact with the lower surface of the inkjet head 8 (see FIG. 9), the communication hole 31B of the second cap section 16B is located at the lowest position in the bottom surface of the concave section 29B. Hence, the ink can be discharged through the communication hole 31B in communication with the cap tube 18.

MODIFICATIONS

While the invention has been described in detail with reference to the above aspects thereof, it would be apparent to those skilled in the art that various changes and modifications may be made therein without departing from the scope of the claims. Here, like parts and components are designated by the same reference numerals to avoid duplicating description.

Figure 12:
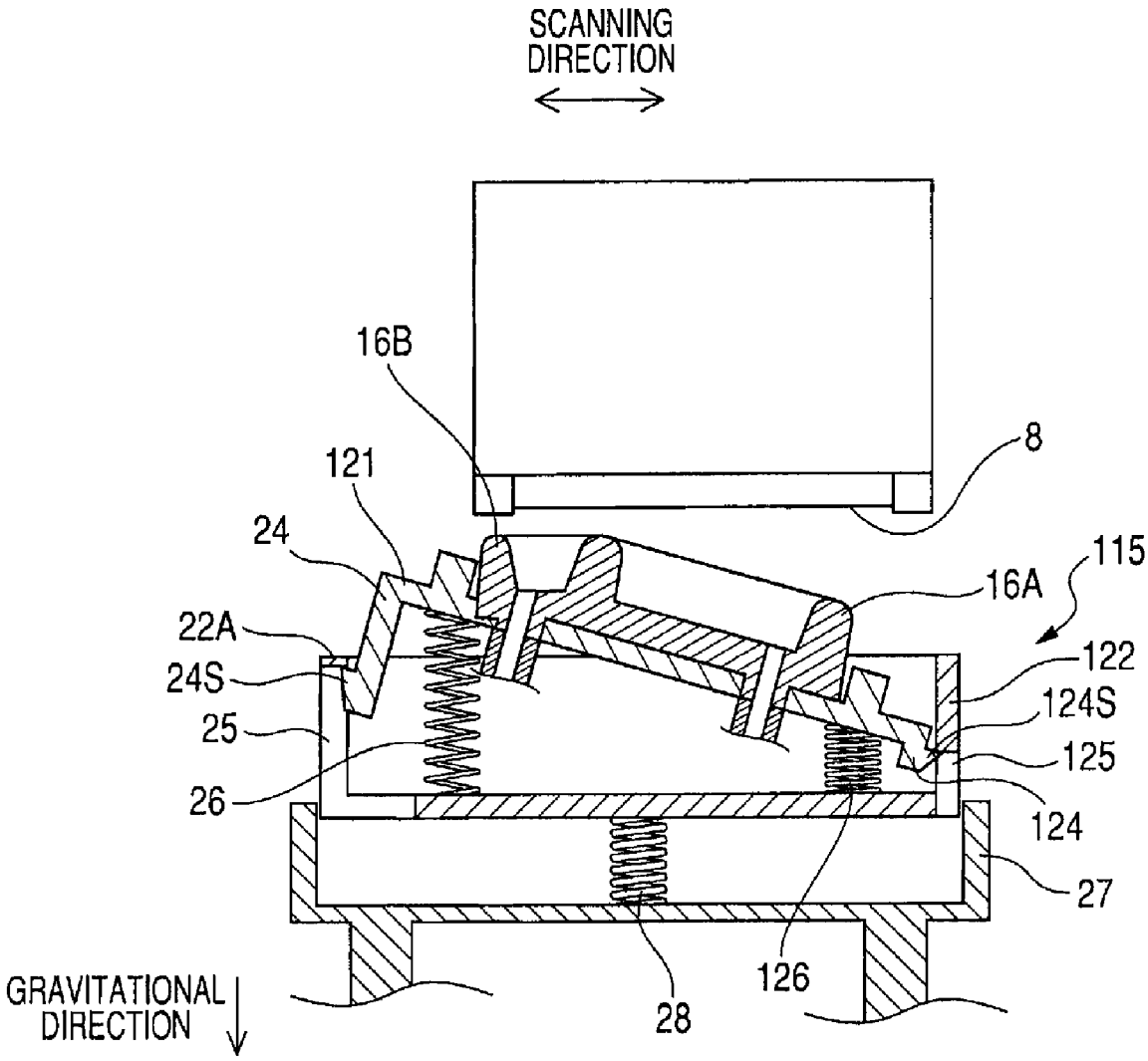
FIG. 12 is a cross-sectional view showing a maintenance unit according to a modification.
Figure 13:
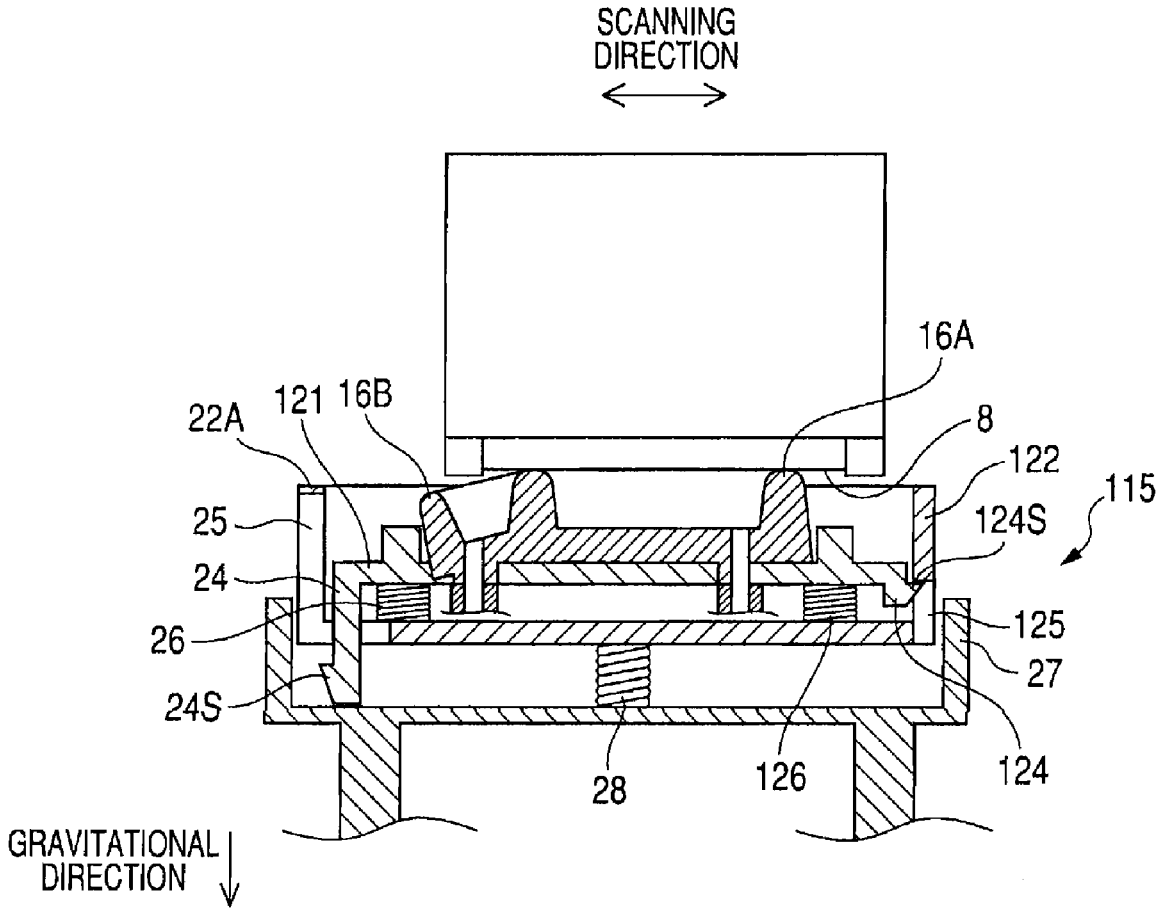
FIG. 13 is a cross-sectional view showing the maintenance unit shown in FIG. 12 during a maintenance operation in which a first cap section is used.

[1] For example, the means for supporting the cap supporting plate 21 for pivotal movement relative to the base 22 is not limited to the pivot shaft 23 for pivotally supporting the cap supporting plate 21 at the base 22. FIG. 12 shows a maintenance unit 115 according to a modification. FIG. 13 shows the maintenance unit 115 during a maintenance operation in which the first cap section 16A is used. In the modification shown in FIGS. 12 and 13, a cap supporting plate 121 is provided with the guide member 24 and a guide member 124 at both ends of the cap supporting plate 121 in the scanning direction.

As shown in FIG. 12, the guide member 124 is shorter than the guide member 24 in the height direction. The guide member 124 has a substantially triangular-shaped stopper section 124S. A guide hole 125 formed in a base 122 is smaller than the guide hole 25, the guide hole 125 being for guiding the guide member 124. The stopper section 124S is fitted in the guide hole 125, and engages the upper end of the guide hole 125 so as to prevent the guide member 124 from separating from the guide hole 125, allowing pivotal movement of the cap supporting plate 121 about the upper end of the guide hole 125. Two compression springs 26 and 126 are provided between the cap supporting plate 121 and the base 122. The compression spring 26 is arranged at the guide hole 25 side, whereas the compression spring 126 is arranged at the guide hole 125 side. The compression spring 126 is arranged between the cap supporting plate 121 and the base 122 in a compressed state. The restoring force generated by the compression of the compression spring 126 is greater than the restoring force of the compression spring 26 acting on the cap supporting plate 121. With the above-described arrangement, when the second cap section 16B is in close contact with the inkjet head 8, the compression spring 26 is compressed. When the first cap section 16A is used, the cap lifting section 85 moves up the seat 27. Here, the restoring force of the compression spring 26 is smaller than the restoring force of the compression spring 126. Thus, when downward force is applied to the cap supporting plate 121, the compression spring 26 is compressed before the compression spring 126 is compressed. Hence, when the suction cap 16 is pressed against the inkjet head 8, the cap supporting plate 121 pivotally moves about the guide member 124 side, and the second cap section 16B separates from the lower surface of the inkjet head 8 (the state shown in FIG. 13). At this time, the first cap section 16A moves toward the inkjet head 8 so as to cover the nozzle arrays 12*a*-12*d* and makes close contact with the lower surface of the inkjet head 8. This is an operation similar to the cap supporting plate 21 supported by the pivot shaft 23 in the above-described embodiment. In this state, because the compression spring 126 is compressed due to pivotal movement of the cap supporting plate 121, the restoring force of the compression spring 126 acts on the cap supporting plate 121, in addition to the restoring force of the compression spring 26. That is, urging force acts on the both ends of the cap supporting plate 121. Accordingly, the first cap section 16A can seal the nozzle arrays 12*a*-12*d* in a balanced manner with respect to the inkjet head 8.

[2] In the above-described embodiment and modification, the maintenance unit 15 and the maintenance unit 115 use the suction cap 16 having the first cap section 16A and the second cap section 16B that are formed as an integral part. However, the first cap section and the second cap section may be formed as separate parts. In this case, the first cap section and the second cap section are arranged in such a manner that, when the second cap section is in contact with the lower surface of the inkjet head, the first cap section is not in contact with the lower surface of the inkjet head, like the above-described embodiment.

[3] In the maintenance unit 15 of the above-described embodiment (see FIG. 4) and the maintenance unit 115 of the above-described modification (see FIG. 12), the suction cap 16 is arranged, at the time when the maintenance unit 15 or 115 is not used, in such an orientation that the bottom surface of the concave section 29B of the second cap section 16B is parallel with the lower surface of the inkjet head 8. However, the second cap section 16B may be configured in such a manner that the bottom surface of the concave section 29B is slanted toward one end or the other end of the cap supporting plate 21 or 121. In this case, because the communication hole 31B is at the lowest position in the bottom surface of the concave section 29B of the second cap section 16B, the ink in the concave section 29B can be easily discharged through the communication hole 31B.

[4] In the above-described embodiment and modification, the compression spring 26 (and the compression spring 126 in the modification) is provided between the cap supporting plate 21 or 121 and the base 22 or 122. However, another kind of elastic member such as rubber can be used to obtain the same effects. The same goes for the compression spring 28.

[5] In the above-described embodiment and modification, the compression spring 26 is arranged at a position at the left side (the far side from the pivot shaft 23) of the cap supporting plate 21. However, the compression spring 26 is not limited to this position. For example, the compression spring 26 may be arranged between the cap tube 17 and the cap tube 18 (see FIG. 4). In this case, because the compression spring 26 becomes closer to the first cap section 16A, the restoring force of the compression spring 26 can be applied to the first cap section 16A more easily. With this arrangement, sealing force for reliably sealing the nozzle arrays 12*a*-12*d* can be obtained when the first cap section 16A is in contact with the lower surface of the inkjet head 8, the first cap section 16A having a larger contact area with the lower surface of the inkjet head 8 than the second cap section 16B does.

[6] In the above-described embodiment, one compression spring 28 is provided. However, a plurality of compression springs 28 may be provided. In this case, the plurality of compression springs 28 can be arranged at distributed positions on the inner bottom surface of the concave section of the seat 27, thereby supporting the base 22 stably. In addition, the urging force acting between the base 22 and the seat 27 increases. Thus, when the first cap section 16A seals the nozzles 12, the sealing force of the first cap section 16A can be increased to reliably seal the nozzles 12.

[7] Similarly, a plurality of compression springs 26 may be provided in order to stabilize the urging force applied to the cap supporting plate 21. In this case, however, the urging force of the plurality of compression springs 26 needs to be less than the urging force of the compression spring 28.

[8] In the printer 1 (see FIG. 1) of the above-described embodiment, the waste ink receiver 13 and the missing-dot detecting section 40 are arranged at the both sides of the print region in the scanning direction. For example, however, the waste ink receiver 13, the missing-dot detecting section 40, the wiper 14, and the maintenance unit 15 may be arranged at one side of the print region in the scanning direction. With this arrangement, the distance between the missing-dot detecting section 40 and the waste ink receiver 13 decreases, thereby shortening the time period prior to performing the flushing operation.

[9] The above-described printer 1 includes a serial-type inkjet head that ejects ink droplets on printing paper P while moving in the width direction of the printing paper P. However, the invention can be applied to a printer including a line-type inkjet head extending over the entire width of printing paper P. In this case, the maintenance unit is configured to move in the direction in which a plurality of nozzle arrays is arranged (i.e., the paper conveying direction).

[10] In the above-described embodiment (see FIG. 3), one nozzle array is provided for each color. For example, one nozzle array 12*a* is provided for black color. However, a plurality of nozzle arrays may be provided for each color. For example, two nozzle arrays may be provided for each of black, yellow, cyan, and magenta (eight nozzle arrays in total). Because the nozzle arrays for the same color are arranged closely in this case, the second cap section 16B can seal the nozzle arrays for the same color all together.

[11] In the above-described embodiment and modification, the invention is applied to an inkjet-type printer which records images and the like by ejecting ink droplets on recording paper P. However, the application of the invention is not limited to such a printer. That is, the invention can be applied to various droplet ejecting devices that eject various kinds of liquid on an object, depending on the usage.

What is claimed is:

1. A droplet ejecting device comprising:

a droplet ejecting head having a nozzle surface formed with a plurality of nozzle arrays, each of the plurality of nozzle arrays including a plurality of nozzles aligned in a first direction, the plurality of nozzle arrays being arranged in a second direction intersecting the first direction;

a first cap capable of sealing the plurality of nozzles in all of the plurality of nozzle arrays;

a second cap capable of sealing the plurality of nozzles in only a part of the plurality of nozzle arrays; and a selecting section that selects one of the first cap and the second cap, and that selects at least one of the plurality of nozzle arrays to be sealed when the second cap is selected, the selecting section comprising:

a base;

a cap supporting member supported by the base for pivotal movement about a pivot section, the cap supporting member supporting the first cap and the second cap on a surface opposite to the base;

an urging member that urges the cap supporting member in a direction away from the base; and a moving section that moves the base relative to the droplet ejecting head, so that one of the first cap and the second cap contacts and separates from the droplet ejecting head, wherein each of the first cap and the second cap comprises:

a concave section having a concave shape; and a lip section configured to be in contact with the nozzle surface, so as to seal the plurality of nozzles when the moving section moves the base toward the droplet ejecting head;

wherein the first cap and the second cap are arranged in the second direction, the first cap being closer to the pivot section than the second cap is;

wherein the concave section of the first cap and the concave section of the second cap facing different directions from each other; and wherein, in a state where the second cap seals the plurality of nozzles in the part of the plurality of nozzle arrays, the first cap is spaced away from the droplet ejecting head in such a manner that the lip section of the first cap is gradually away from the nozzle surface toward a pivot section side.

2. The droplet ejecting device according to claim 1, further comprising a liquid sucking section that sucks liquid in the droplet ejecting head through the plurality of nozzles, wherein the selecting section selects one of the first cap and the second cap, so that the liquid sucking section sucks liquid in the droplet ejecting head through the plurality of nozzles by selected one of the first cap and the second cap.

3. The droplet ejecting device according to claim 1, wherein the cap supporting member has one end supported by the base for pivotal movement about the pivot section and another end opposite to the one end; and wherein the urging member urges a position of the cap supporting member between the one end and the another end.

4. The droplet ejecting device according to claim 1, wherein the selecting section further comprises:

a seat provided at a side opposite to the cap supporting member with respect to the base, the seat having a surface in confrontation with the base, the surface being parallel with the nozzle surface, the seat being connected to the moving section; and a base urging member provided between the seat and the base, the base urging member being configured to urge the base in a direction away from the seat.

5. The droplet ejecting device according to claim 1, wherein the droplet ejecting head further comprises a nozzle protector that protrudes from the nozzle surface, the nozzle protector being arranged to surround the plurality of nozzles in all of the plurality of nozzle arrays when viewed in a direction perpendicular to the nozzle surface; and wherein the nozzle protector is arranged so as not to contact the first cap when the first cap seals the plurality of nozzles in all of the plurality of nozzle arrays, and so as not to contact the second cap when the second cap seals the plurality of nozzles in the part of the plurality of nozzle arrays.

6. The droplet ejecting device according to claim 1, wherein the pivot section comprises a pivot shaft extending in the first direction.

7. The droplet ejecting device according to claim 1, wherein the pivot section comprises:

a guide hole formed in the base; and a stopper section fitted in the guide hole and engaging the guide hole, allowing pivotal movement of the cap supporting member.

8. The droplet ejecting device according to claim 1, wherein the plurality of nozzle arrays is arranged in parallel with each other; and wherein the second direction is substantially perpendicular to the first direction.

9. The droplet ejecting device according to claim 1, wherein the concave section of the first cap is formed with a communication hole through which liquid can be discharged; and wherein the communication hole is located at a lowest position in a bottom surface of the concave section of the first cap, at least when the base is lowered so that both of the first cap and the second cap are spaced away from the nozzle surface.

10. The droplet ejecting device according to claim 1, wherein the plurality of nozzles ejects an ink droplet on a recording medium; and wherein the droplet ejecting device functions as an inkjet recording device.

* * * * *